United States Patent [19]

Anthony

[11] 4,065,737

[45] Dec. 27, 1977

[54] STATIC CONVERGENCE DEVICES FOR COLOR TELEVISION PICTURE TUBES

[75] Inventor: Albert M. Anthony, Bangor, Mich.

[73] Assignee: Tracor, Inc., Austin, Tex.

[21] Appl. No.: 735,044

[22] Filed: Oct. 22, 1976

Related U.S. Application Data

[63] Continuation-in-part of Ser. No. 732,101, Oct. 13, 1976, Pat. No. 4,050,042.

[51] Int. Cl.[2] ..... H01J 29/68

[52] U.S. Cl. ..... 335/212; 358/249

[58] Field of Search ..... 335/210, 211, 212; 358/248, 249

[56] References Cited

U.S. PATENT DOCUMENTS

| | | | |
|---|---|---|---|
| 2,525,919 | 10/1950 | Loughren | 335/212 UX |
| 3,330,979 | 7/1967 | Constantine | 335/212 X |
| 3,646,669 | 3/1972 | Erickson | 335/212 X |
| 3,898,597 | 8/1975 | Vonk | 335/212 |
| 3,902,145 | 8/1975 | Slavenburg | 335/212 |

*Primary Examiner*—A. D. Pellinen

*Attorney, Agent, or Firm*—Burmeister, York, Palmatier, Hamby & Jones

[57] ABSTRACT

Each convergence device is particularly adapted for converging the three electron beams of an in-line picture tube. Each convergence device comprises a mounting sleeve having an axial opening for receiving the neck of the picture tube, and a plurality of beam adjusting assemblies mounted around the supporting sleeve. Each beam adjusting assembly may comprise a rotatable supporting ring, a pair of rotatable magnet rings stacked upon the mounting ring, the magnet rings having integral bevel gears facing toward each other, a radial shaft having a bevel pinion meshing with such gears, and a member on the supporting ring and rotatably supporting the shaft. Each magnet ring is formed with permanent magnetic poles. The orientation of the poles can be varied by rotating the entire beam adjusting assembly about the axis of the picture tube. The effective strength of the poles can be adjusted by rotating the shaft, which causes rotation of the magnet rings in opposite directions. In one embodiment, there are two such beam adjusting assemblies, plus a third similar assembly in which the supporting ring is replaced by a flange on the mounting sleeve. In a second embodiment, there are three of the rotatable beam adjusting assemblies, which are stacked and pressed together by springs. A clamping device produces increased clamping pressure between the adjusting assemblies to retain the adjustment thereof.

22 Claims, 31 Drawing Figures

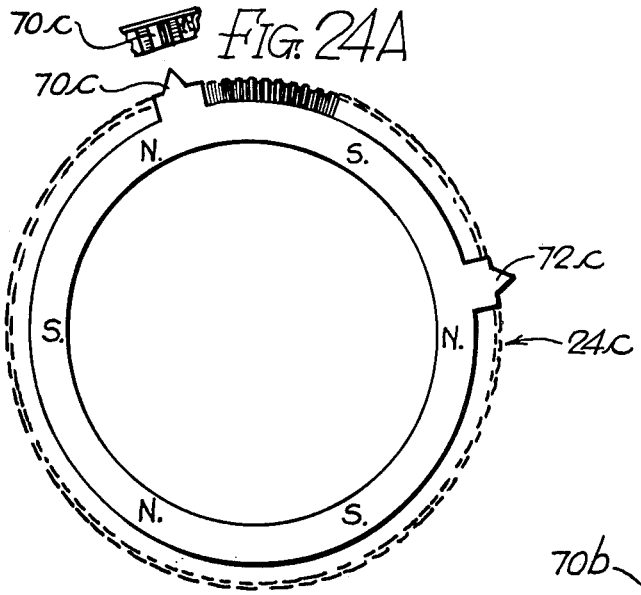
FIG. 24A
FIG. 24
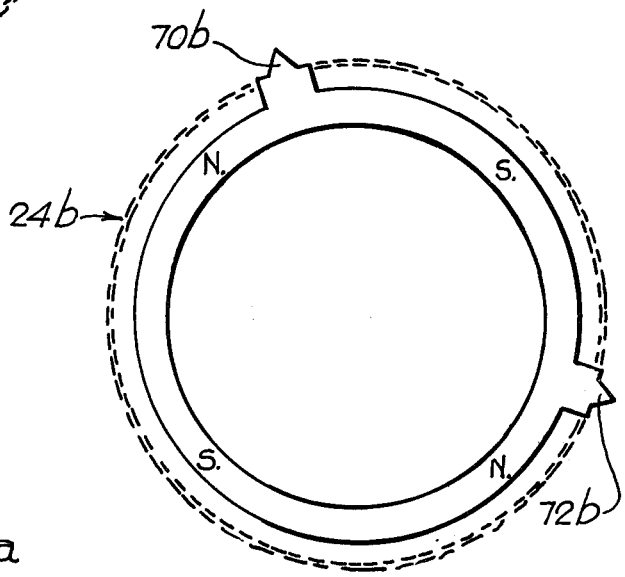
FIG. 23
FIG. 25
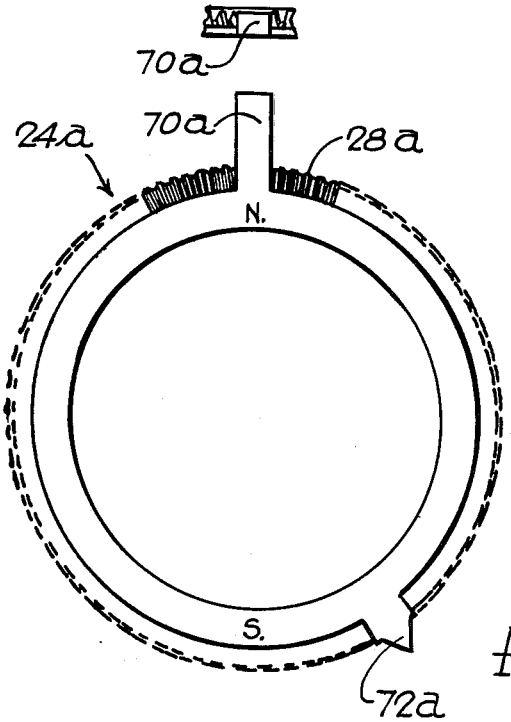
FIG. 22

STATIC CONVERGENCE DEVICES FOR COLOR TELEVISION PICTURE TUBES

This application is a continuation-in-part of my copending application, filed Oct. 13, 1976, Ser. No. 732,101 now U.S. Pat. No. 4,050,042.

This invention relates to static convergence devices for initially converging the three electron beams of a color television picture tube, particularly a tube of the type having three in-line beams.

One object of the present invention is to provide a new and improved convergence device of the type utilizing movable beam adjusting members having permanent magnet poles to produce adjustable magnetic fields for bending the beams and thereby converging them.

A further object is to provide a new and improved convergence device having a plurality of beam adjusting assemblies, each of which can be adjusted very easily and quickly to change both the orientation and the effective strength of the magnetic fields produced by the magnet poles.

In accordance with the present invention, the static convergence device may comprise a supporting sleeve having an axial opening for receiving the neck of a color television picture tube, and at least one beam adjusting assembly mounted around such sleeve. Three such adjusting assemblies are preferably provided. Each beam adjusting assembly may comprise a supporting ring around the mounting sleeve, a pair of rotatable magnet rings stacked upon the supporting ring and having integral bevel gears facing toward each other, a radial shaft having a bevel pinion meshing with both bevel gears and preferably held captive therebetween, and a member on the supporting ring and having means for rotatably supporting the shaft for rotation about a radial axis.

In one embodiment, one of the beam adjusting assemblies has a supporting ring which is formed integrally with the mounting sleeve as a flange thereon. The other two beam adjusting assemblies include supporting rings which are rotatable about the mounting sleeve.

In another embodiment, all three of the beam adjusting assemblies include supporting rings which are rotatable about the mounting sleeve.

The beam adjusting assemblies are retained in a stack and are preferably pressed together by springs. A clamping device is preferably provided for producing increased clamping pressure upon the beam adjusting assemblies to hold them in their adjusted positions.

Further objects, advantages and features of the present invention will appear from the following description, taken with the accompanying drawings, in which:

FIG. 22 is an enlarged end view of one of the 2-pole magnet rings.

FIG. 23 is an enlarged end view of one of the 4-pole magnet rings.

FIG. 24 is an enlarged end view of one of the 6-pole magnet rings.

FIG. 24A is a fragmentary auxiliary view showing one of the stops of the magnet ring of FIG. 24.

FIG. 25 is a fragmentary auxiliary view showing a stop tab on the magnet ring of FIG. 22.

As just indicated, FIGS. 1-4 of the drawings illustrate an illustrative embodiment of the present invention, in the form of a static convergence device 10, adapted to be mounted around the neck 12 of a color television picture tube, particularly of the type having three in-line electron beams 14R, G and B, where R, G and B stand for the colors red, green and blue, produced by the electron beams on the screen of the picture tube. The purpose of the convergence device 10 is to converge all three beams initially on the desired spot. This is done by producing variable magnetic fields to bend the three beams.

Figures 1, 2, 3, 4, 4A:
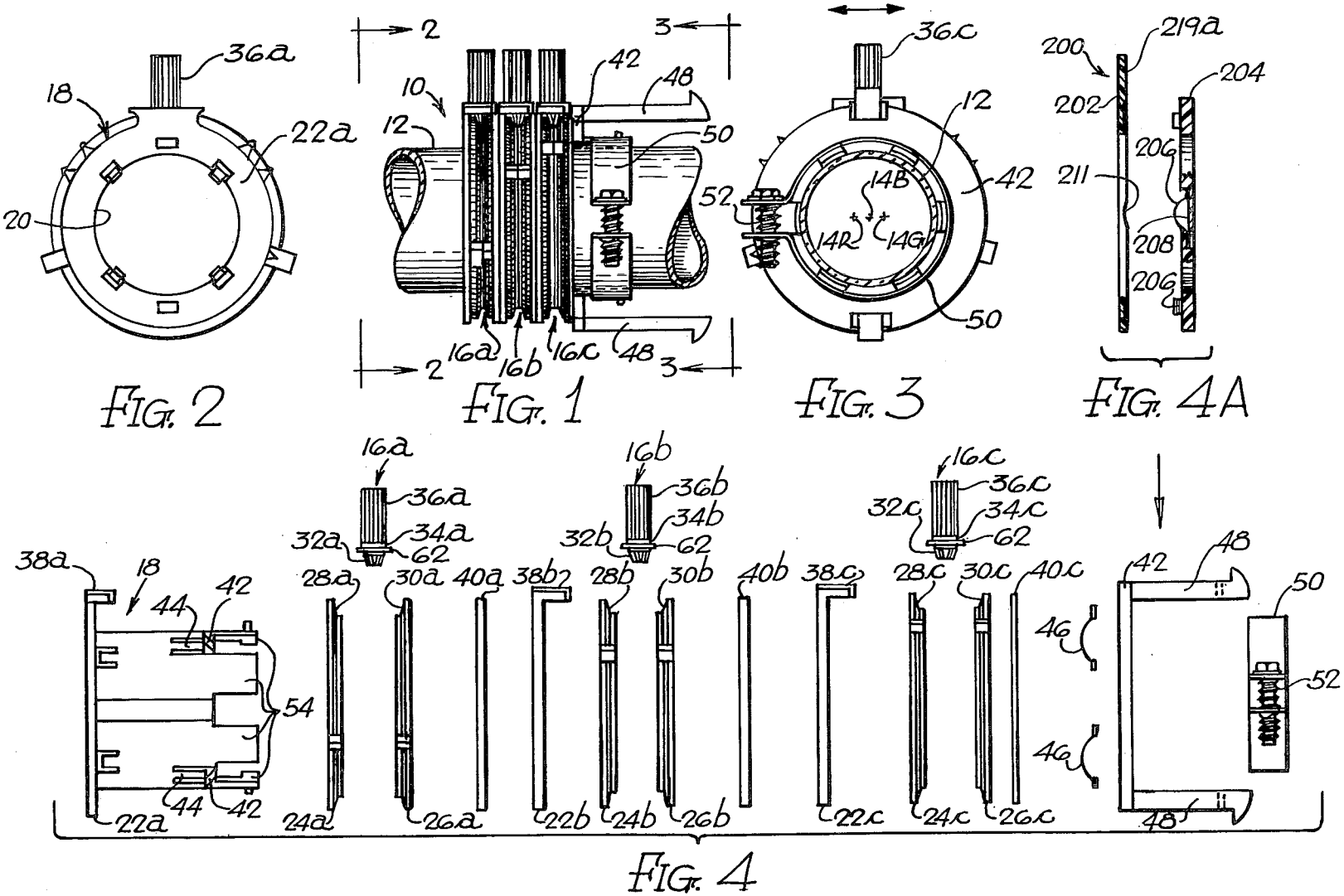
FIG. 1 is a side elevational view of a static convergence device to be described as one illustrative embodiment of the present invention.
FIGS. 2 and 3 are end views taken from the opposite ends of the convergence device of FIG. 1.
FIG. 4 is an exploded side elevational view of the convergence device of FIG. 1, showing the disassembled components of the device.
FIG. 4A is an exploded sectional view corresponding to a portion of FIG. 4 and illustrating a clamping device which may be incorporated into the convergence device of FIG. 4.

The illustrated convergence device 10 comprises three beam adjusting assemblies or units 16*a*, *b* and *c* which are supported by a supporting sleeve 18, shown to best advantage in FIG. 4. The supporting sleeve 18 has an axial opening 20 for receiving the neck 12 of the picture tube.

In this case, the first beam adjusting assembly 16*a* is slightly different mechanically from the other two beam adjusting units 16*b c*, and c, which are the same mechanically. The beam adjusting unit 16*a* comprises a supporting ring 22*a*, which in this case is in the form of a ring-shaped flange formed integrally with the supporting sleeve 18. Magnet rings 24*a* and 26*a* are rotatably mounted around the supporting sleeve 18 and are stacked upon the supporting ring 22*a*. Bevel gears 28*a* and 30*a* are formed in one piece with the magnet rings 24*a* and 26*a*, respectively, and are oriented so as to face each other. The bevel gears 28*a* and 30*a* mesh with the opposite sides of a pinion gear 32*a* formed on a rotatable adjusting shaft 34*a* which has a manually operable knob portion 36*a*. The shaft 34*a* is rotatably supported by a member 38*a* on the supporting ring 22*a*. The shaft 34*a* is supported for rotation about a radial axis. When the shaft 34*a* is rotated, the magnet rings 24*a* and 26*a* are rotated in opposite directions.

The beam adjusting assemblies 16*b* and 16*c* are the same mechanically. Each of them comprises a supporting ring 22*b/c* which is rotatably supported on the supporting sleeve 18. Rotatable magnet rings 24*b/c* and 26*b/c*, similar to the magnet rings 24*a* and 26*a*, are stacked against the supporting ring 22*b/c*. As before, the magnet rings 24*b/c* and 26*b/c* are formed with integral bevel gears 28*b/c* and 30*b/c* which mesh with the opposite sides of a bevel pinion 32*b/c* on a rotatable shaft 34*b/c* having a manually rotatable knob portion 36*b/c*. The shaft 34*b/c* is rotatably supported by a member 38*b/c* on the supporting ring 22*b/c*.

The beam adjusting assemblies, 16*a*, *b* and *c* are stacked upon the supporting sleeve 18. To facilitate the independent adjustment of the three assemblies, a washer 40*a* is interposed between the magnet ring 26*a* and the second supporting ring 22*b*. Similarly, a washer 40*b* is interposed between the magnet ring 26*b* and the third supporting ring 22*c*. A third washer 40*c* is stacked against the magnet ring 26*c*.

The beam adjusting assemblies 16*a*, *b* and *c* are retained on the supporting sleeve 18 by retaining means, which may comprise a retaining ring 42, received around the supporting sleeve 18 and retained thereon by a plurality of barbs or catches 42, formed on resilient spring fingers 44. One or more springs 46 are preferably provided to press the stacked beam adjusting assemblies 16*a*, *b* and *c* together. As shown, the springs 46 are in the form of a plurality of bow springs compressed between the retainer ring 42 and the washer 40*c*. The illustrated retainer ring 42 has a pair of bracket arms 48, which, however, can be omitted, if not needed to support other components.

The illustrated convergence device 10 includes a ring clamp 50 for clamping the supporting sleeve 18 around the neck 12 of the picture tube. The ring clamp 50 includes an adjustable clamping screw 52. It will be seen that the ring clamp 50 encircles a plurality of clamping fingers 54, formed on one end of the supporting sleeve 18, the other end being formed with the supporting ring 22*a*.

As shown to best advantage in FIGS. 11–21, each of the rotatable adjusting shafts 34*a*, *b* and *c* is preferably received in a generally U-shaped bearing seat 60 (FIGS. 16 and 18–21) formed in the corresponding supporting member 38*a*, *b* or *c*. It will be seen that each bearing seat 60 has an open side facing away from the corresponding supporting ring 22*a*, *b* or *c*.

Figures 5, 6, 7, 8, 9, 10, 10A, 11, 12, 13, 14:
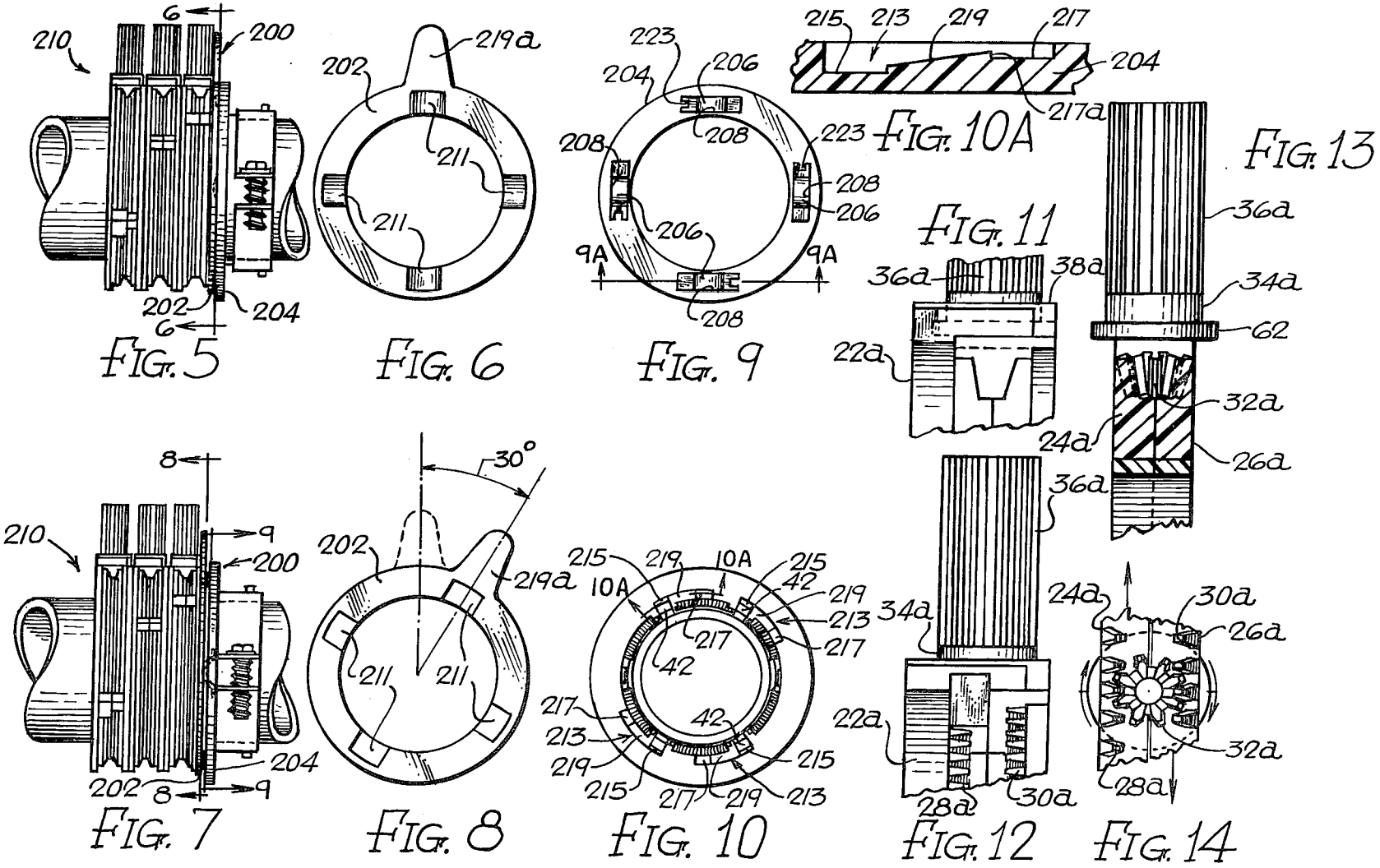
FIG. 5 is a side elevation, similar to FIG. 1, but showing a modified convergence device which incorporates the clamping device of FIG. 4A, the clamping device being shown in its released position.
FIG. 6 is an end view of an operating ring employed as one component of the clamping device, the view being taken generally as indicated by the line 6—6 in FIG. 5.
FIG. 7 is an elevation similar to FIG. 5, but showing the clamping device in its actuated position.
FIG. 8 is an end view of the operating ring in its actuated position, the view being taken generally as indicated by the line 8—8 in FIG. 7.
FIG. 9 is a end view of a spring supporting ring, also employed as a component of the clamping device, the view being taken as indicated by the line 9—9 in FIG. 7.
FIG. 10 is an end view of the convergence device of FIG. 7, showing the opposite side of the spring supporting ring.
FIG. 10A is a fragmentary enlarged diagrammatic section, taken generally along the line 10A—10A in FIG. 10.
FIG. 11 is a fragementary enlarged diagrammatic elevation of one of the beam adjusting assemblies for the embodiments of FIGS. 1-10.
FIG. 12 is a view similar to FIG. 11, but showing one of the stops on one of the magnet rings.
FIG. 13 is a fragmentary enlarged section taken through one of the beam adjusting assemblies, and showing the pinion gear meshing with the corresponding bevel gears.
FIG. 14 is a diagrammatic end view showing the pinion gear of FIG. 13.

Flange means are preferably provided to retain the shafts 34*a*, *b* and *c* in the bearing seats 60 against radial movement. As shown in FIGS. 4 and 13, each of the shafts 34*a*, *b* and *c* is formed with an outwardly projecting ring-shaped flange 62, adapted to be received and held captive in a groove 64 (FIGS. 18–21) formed in the corresponding bearing seat 60.

When the convergence device 10 is fully assembled, each of the pinions 32*a*, *b* and *c* is held captive between the corresponding bevel gears 28*a*, *b* and *c* and 30*a*, *b* and *c*, so that each of the shafts 34*a*, *b* and *c* is retained in its bearing seat 60. The provision of the open-sided bearing seats 60 makes it easy to assemble the convergence device 10.

Each of the magnet rings 24*a*, *b*, *c* and 26*a*, *b*, *c* preferably has two outwardly projecting stops 70*a*, *b*, *c*, and 72*a*, *b*, *c*, which are engageable with the pertinent supporting member 38*a*, *b*, *c*. The stops establish the angular ranges through which the magnet rings 24*a*, *b*, *c* and 26*a*, *b*, *c* are rotatable.

As indicated in FIGS. 22, 23 and 24, the first pair of magnet rings 24*a* and 26*a* have two magnetic poles and are rotatable through approximately 180°. The poles are indicated as N and S in FIG. 22, standing for North and South.

The magnet rings 24*b* and 26*b* of the second pair have four magnetic poles, as indicated in FIG. 23, and are rotatable through approximately 90°.

The magnet rings 24*c* and 26*c* of the third pair have six magnetic poles, as indicated in FIG. 24, and are rotatable through approximately 60°.

The 2-pole magnet rings 24*a* and 26*a* produce a diametrical magnetic field which causes substantially equal bending of all three electron beams. The direction of the bending is determined by the angle to which the first beam adjusting assembly 16*a* is adjusted. In the convergence device 10 of FIGS. 1–4, this adjustment is made by turning the supporting sleeve 18 about the neck 12 of the television picture tube. The magnitude of the beam bending is varied by manually rotating the adusting shaft 34*a*, so as to rotate the magnetic rings 24*a* and 26*a* in opposite directions. The maximum beam bending is achieved when like magnetic poles on both rings 24*a* and 26*a* are aligned, north opposite north and south opposite south. The beam bending is substantially zero when unlike magnetic poles are aligned, north opposite south and south opposite north, so that the magnetic fields produced by the two magnet rings 24*a* and 26*a* substantially neutralize each other.

Inasmuch as the magnet rings 24*a* and 26*a* of the first beam adjusting assembly 16*a* cause substantially equal bending of the three electron beams, these rings provide a color purity adjustment. These rings adjust the position of the spot on which all three beams are converged initially.

The four poles of the second magnet rings 24b and 26b are substantially equally spaced around the rings. These magnet rings 24b and 26b produce a magnetic field which tends to bend the two outer electron beams in opposite directions, while having substantially no bending effect upon the central beam. The directions in which the outer beams are bent can be varied by rotating the second beam bending assembly 16b about the axis of the supporting sleeve 18. Such adjustment is effected by using the shaft 34b as a handle to rotate the supporting ring 22b about the supporting sleeve. The extent to which the outer electron beams are bent can be varied by rotating the adjusting shaft 34b, so as to rotate the magnet rings 24b and 26b in opposite directions. The maximum beam bending effect is achieved when like magnetic poles of the two rings 24b and 26b are aligned, north opposite north and south opposite south. The bending effect is substantially zero when the rings 24b and 26b are rotated so that unlike magnetic poles of the two rings are aligned, north opposite south and south opposite north. At intermediate positions of the magnet rings, the beam bending effect is between zero and the maximum amount.

In the third magnet rings 24c and 26c, the six magnetic poles are substantially equally spaced around the rings. The six poles produce a magnetic field which tends to bend the two outer electron beams in the same direction while leaving the central electron beam substantially undisturbed. The direction of the beam bending can be varied by rotating the third beam adjusting assembly 16c about the axis of the supporting sleeve 18. This is accomplished by using the third adjusting shaft 34c as a handle to rotate the supporting ring 22c about the axis of the supporting sleeve 18. The magnitude of the beam bending can be adjusted by rotating the shaft 34c so as to rotate the magnet rings 24c and 26c in opposite directions. The maximum beam bending is achieved when like magnetic poles on the two rings 24c and 26c are aligned, north opposite north and south opposite south. The beam bending can be diminished by rotating the rings 24c and 26c toward the position of substantially zero beam bending, in which unlike magnetic poles are aligned, north opposite south and south opposite north, so that the magnetic fields of the two magnet rings 24c and 26c substantially neutralize each other.

The magnet rings 24a, b, c and 26a, b, c are made of a material which can be magnetized, and also can be molded to form the bevel gears 28a, b, c and 30a, b, c. For example, the magnet rings may be made of a mixture of a finely divided ferrite material and a moldable resinous plastic material. If desired, the ferrite material may constitute about 75% of the mixture, while the moldable resinous plastic material may constitute about 25% thereof. It will be understood that the proportions may be varied widely.

Figure 17:
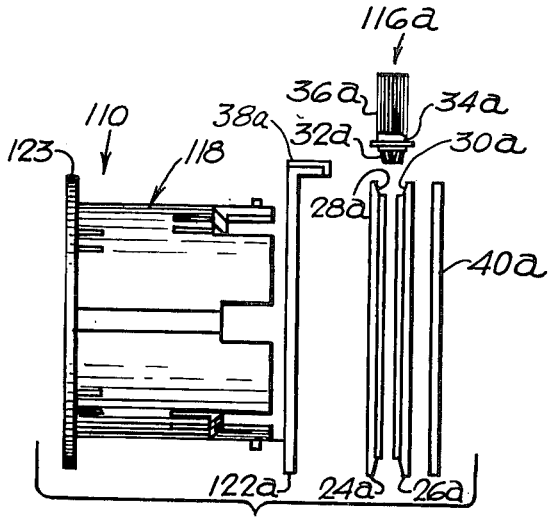
FIG. 17 is a fragmentary exploded elevation corresponding to the left-hand portion of FIG. 4, but showing a modifid convergence device in which the supporting ring of the first beam adjusting assembly is rotatable about the supporting sleeve.
Figure 19:
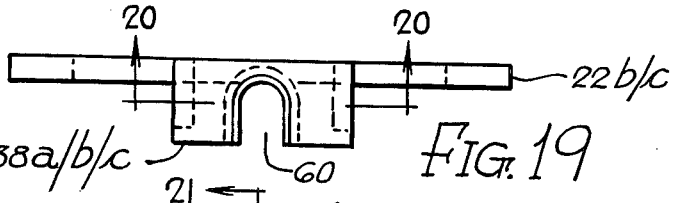
FIG. 19 is a top view, taken as indicated by the line 19—19 of FIG. 18.
Figure 18:
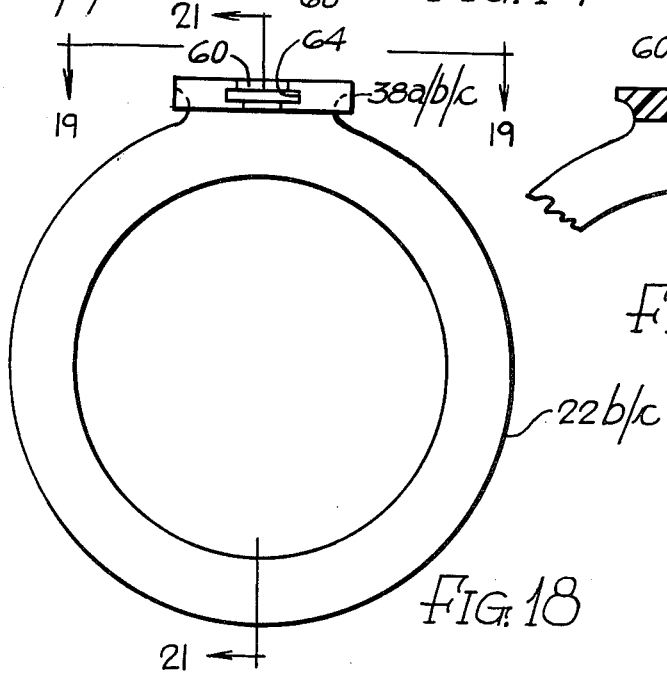
FIG. 18 is a right-hand end view of one of the rotatable supporting rings of FIGS. 4 and 17.
Figure 20:
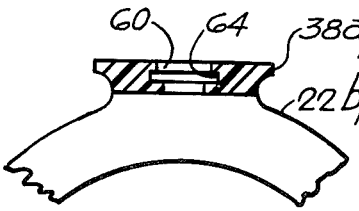
FIG. 20 is a fragmentary section, taken generally along the line 20—20 in FIG. 19.
Figure 21:
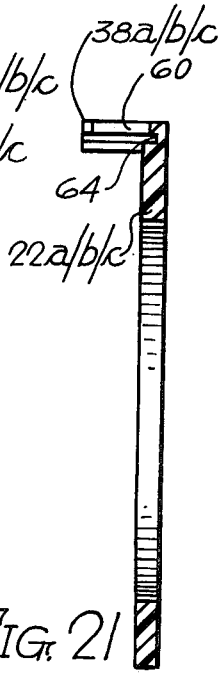
FIG. 21 is a section taken generally along the line 21—21 in FIG. 18.

FIG. 17 illustrates a modified convergence device 110, which is the same as the convergence device 10 of FIGS. 1–4, except that the first beam adjusting assembly 16a is replaced with a slightly modified beam adjusting assembly 116a having a supporting ring 122a which is rotatable about a modified supporting sleeve 118. The supporting ring 122a may be exactly the same as the supporting rings 22b and *c* of FIGS. 1–4. In the modified convergence device 110 of FIG. 17, the rotatable supporting ring 122a slideably engages an end flange 123 on the mounting sleeve 118. In FIG. 17, the magnet rings 24a and 26a, the bevel gears 28a and 30a, the bevel pinion 32a, the adjusting shaft 34a, the knob 36a and the supporting member 38a may be the same as described in connection with FIGS. 1–4. Moreover, all of the other components of the convergence device 110 may be the same as described in connection with FIGS. 1–4.

In the operation of the convergence device 110 of FIG. 17, the entire first beam adjusting assembly 116a can be adjusted as to angular position by turning the assembly around the supporting sleeve 118. This is done by using the shaft 34a as a handle to rotate the supporting ring 122a. In this way, the direction of the magnetic field produced by the magnet rings 24a and 26a can be varied, so as to vary the direction in which the three electron beams are bent.

FIG. 4A illustrates a clamping or locking device 200 which is adapted to replace the retaining ring 41 of FIG. 4. Thus, the locking device 200 can easily be incorporated into the convergence device 10 of FIGS. 1–4. The clamping device 200 comprises a camming or operating ring 202 and a spring supporting ring 204. In this case, the ring 204 supports a plurality of bow springs 206 which are seated in recesses 208 formed in the ring 204. The bow springs 208 may be similar to the bow springs 46.

FIGS. 5–10A illustrate a modified convergence device 210 which incorporates the clamping device 200 of FIG. 4A. Otherwise, the convergence device 210 may be the same as the convergence device 10 of FIGS. 1–4, or the same as the modified convergence device 110 of FIG. 17.

As shown in FIG. 9, there are four of the bow springs 206 and four recesses 208. The operating ring 202 is formed with corresponding camming recesses 211 for receiving the bow springs 206.

The spring supporting ring 204 is retained on the supporting sleeve 18 by the barbs 42 formed on the spring fingers 44. Thus, the operating ring 202 and the spring supporting ring 204 are stacked on the supporting sleeve 18 to replace the retaining ring, 42, which is not used.

The ends of the barbs 42 are also shown in FIG. 10, which is a right-hand end view of the convergence device 210. In this case, there are four of the barbs 42.

It will be seen from FIGS. 10 and 10A that the barbs 42 are adapted to snap into recesses 213 formed in the ring 204. Such recesses 213 are formed in the outer side of the ring 204, while the spring receiving recesses 208 are formed in the inner side thereof, with respect to the position of the ring 204 when it is assembled on the convergence device 210.

As shown in FIG. 10A, each recess 213 has a deep portion 215 at one end, a shallower portion 217 at the opposite end, and a ramp 219 therebetween. The four barbs 42 are snapped initially into the deep portions 215 of the corresponding recesses 213. The ring 204 is then rotated so that the barbs 42 ride up the ramps 219 into the shallower portions 217 of the recesses 213. This rotation of the ring 204 increases the compression of the bow springs 206 so that they exert a greater pressure upon the components of the beam adjusting devices 16a, b and *c*. A shoulder 217a is preferably formed between each shallower recess portion 217 and the corresponding ramp 219, to detain the corresponding barb 42 in the recess portion 217, against accidental displacement.

It will be understood that the recesses 213 in the retaining ring 204 constitute camming means for initially compressing the springs 206. The ramps 219 act as camming elements which are engaged and followed by the barbs 42.

Figure 9B:
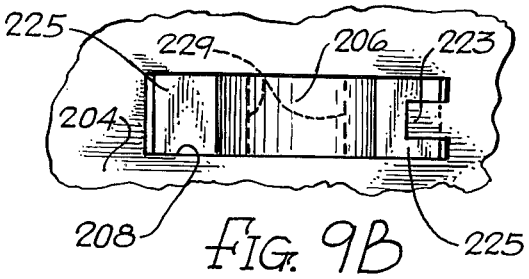
FIG. 9B is a fragmentary elevation, taken as indicated by the line 9B—9B in FIG. 9A.
Figure 9A:
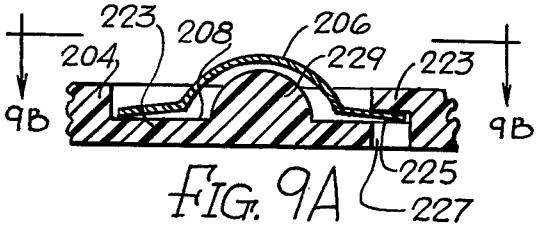
FIG. 9A is a fragmentary enlarged section taken generally along the line 9A—9A in FIG. 9.

As shown in FIGS. 9, 9A and 9B, the bow springs 206 are retained in the recesses 208 by tabs or flanges 223. Each tab 223 projects into and overhangs one end portion of the corresponding recess. Each bow spring 206 has flat end portions 225, one of which is retained under the corresponding tab 223. A rectangular opening 227 is formed in the outer side of the ring 204, opposite each of the tabs 223, to facilitate the molding of the tabs. The shape of the openings 227 is the same as that of the tabs 223.

As shown in FIGS. 9A and 9B, bosses or projections 229 are preferably provided on the ring 204 and are preferably disposed in the recesses 208, behind the bow springs 206. The illustrated bosses 229 are formed in one piece with the ring 204 and are cylindrically curved in shape. It will be seen that the bosses 229 back up the springs 206 and limit the extent to which the springs can be compressed.

When the clamping device 200 is released, the clamp operating ring 202 is in the position shown in FIGS. 5 and 6. The bow springs 206 are received in the recesses 211 in the clamp operating ring 202, and are not heavily compressed.

The clamping device 200 is actuated by turning the clamp operating ring 202 through a small angle, such as about 30°. This is facilitated by providing an outwardly projecting handle 219*a* on the ring 202. The rotation of the ring 202 causes the bow springs 206 to ride up out of the recesses 211, so that the compression of the springs 206 is increased to such an extent that the central portions of the bow springs 206 are solidly engaged with the bosses or projections 229 on the spring supporting ring 204. Because of this solid engagement, the stacked beam adjusting devices 16*a*, 16*b* and 16*c* are quite solidly or heavily clamped, so that they will be maintained in their adjusted positions, against unwanted displacement, due to vibration and other environmental factors. The locking device 200 is shown in its clamped or actuated position in FIGS. 7 and 8.

Figure 6A:
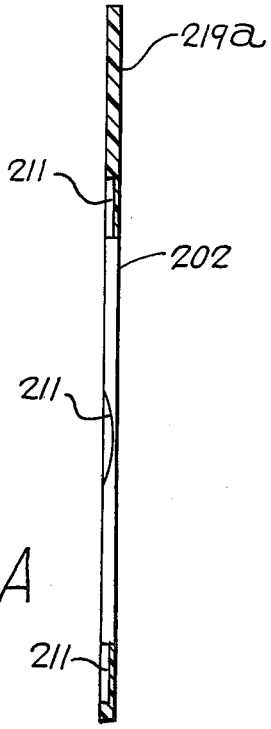
FIG. 6A is a central section, taken through the ring of FIG. 6.
Figure 16:
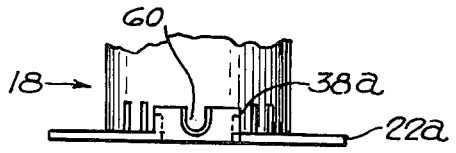
FIG. 16 is a fragmentary top view taken generally as indicated by the line 16—16 in FIG. 15.
Figure 15:
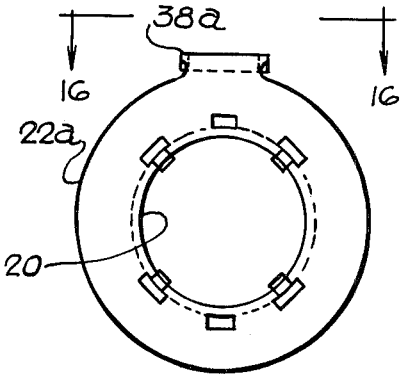
FIG. 15 is an enlarged left-hand view of the supporting sleeve of FIG. 4.

As shown to best advantage in FIG. 6A, the recesses 211 in the clamp operating ring 202 are preferably curved or tapered in cross section, to provide a smooth and easy camming action between the recesses 211 and the bow springs 206, when the clamp operating ring 202 is turned so as to cause the bow springs 206 to be cammed out of the recesses 211.

As previously indicated, the magnet rings 24*a, b, c* and 26*a, b, c* may be made of a mixture of a finely divided ferrite material and a moldable resinous plastic material. For example, such moldable resinous plastic material may be nylon. Other materials may be employed, such as polypropylene and polysulfone, for example.

I claim:

1. A convergence device for television picture tubes,
comprising a mounting sleeve having an axial opening for receiving the neck of a television picture tube,
three beam adjusting assemblies supported on said mounting sleeve,
each of said beam adjusting assemblies including a supporting ring member projecting outwardly from said mounting sleeve,
a pair of magnet rings rotatably mounted around said mounting sleeve and stacked with said supporting ring member,
said magnet rings having respective bevel gears formed in one piece with said magnet rings and facing toward each other,
a rotatable generally radial adjusting shaft having a bevel pinion meshing with and disposed between said bevel gears on said magnet rings,
and shaft supporting means on said supporting ring member and supporting said shaft for rotation about a generally radial axis relative to the axis of the mounting sleeve,
said shaft being rotatable to cause rotation of said magnet rings in opposite directions about the axis of said mounting sleeve,
each of said magnet rings being formed with a plurality of magnetic poles,
at least two of said beam adjusting assemblies being rotatable about said supporting sleeve,
and retaining means for retaining said beam adjusting assemblies in stacked relation on said mounting sleeve,
said retaining means including a retaining ring mounted on said sleeve,
a camming ring rotatably mounted on said sleeve between said retaining ring and said beam adjusting assemblies,
spring means disposed between said retaining ring and said camming ring,
and camming means on said camming ring and operable by rotation of said camming ring for producing increased compression of said spring means to increase the clamping force exerted upon said beam adjusting assemblies.

2. A device according to claim 1,
in which said spring means include a plurality of compression springs interposed between said retaining ring and said camming ring for producing spring pressure upon said beam adjusting assemblies,
said camming ring having camming recesses for initially receiving said compression springs,
said camming ring being rotatable to cause said compression springs to ride up and out of said camming recesses to increase the clamping pressure exerted upon said beam adjusting assemblies.

3. A device according to claim 2,
in which said compression springs take the form of bow springs mounted on said retaining ring and engaging said camming ring.

4. A device according to claim 3,
in which said retaining ring is formed with spring receiving recesses for receiving said bow springs.

5. A device according to claim 2,
in which said compression springs take the form of bow springs mounted on said retaining ring and engaging said camming ring,
said retaining ring being formed with spring receiving recesses for receiving said bow springs,
said retaining ring having projections thereon behind said springs and in said recesses for solidly limiting the compression of said springs whereby rotation of said camming ring produces solid engagement between said springs and said projections and solid clamping of said beam adjusting assemblies.

6. A device according to claim 5,
in which said projections take the form of rounded bosses on said retaining ring.

7. A device according to claim 1, including means for solidly limiting the compression of said spring means to produce solid clamping of said beam adjusting assemblies in response to rotation of said camming ring.

8. A device according to claim 1, including projections on said retaining ring for solidly limiting the compression of said spring means to produce solid clamping of said beam adjusting assemblies in response to rotation of said camming ring.

9. A device according to claim 2, including projections on said retaining ring and backing up said compression springs for solidly limiting the compression of said springs to produce solid clamping of said beam adjusting assemblies in response to rotation of said camming ring.

10. A device according to claim 2, including additional camming means disposed between said sleeve and said retaining ring for initially compressing said springs, said additional camming means including cam elements operable by rotation of said retaining ring.

11. A device according to claim 10, in which said cam elements are formed on said retaining ring, said sleeve having cam engaging elements for engaging said cam elements.

12. A device according to claim 10, in which said cam elements are formed on said retaining ring, said sleeve including barbs for engaging and following said cam elements.

13. A device according to claim 12, in which each of said cam elements includes a relatively deep recess element for initially receiving the corresponding barb, a relatively shallower recess element angularly spaced from said relatively deep element, and a camming ramp extending between said relatively deep element and said shallower element for carrying said barb therebetween to compress said springs.

14. A convergence device for television picture tubes, comprising a mounting sleeve having an axial opening for receiving the neck of a television picture tube, three beam adjusting assemblies stacked on said mounting sleeve, each of said beam adjusting assemblies including a pair of magnet rings rotatably mounted around said mounting sleeve and stacked thereon, and means for producing rotation of said magnet rings in opposite directions about the axis of said mounting sleeve, each of said magnet rings being formed with a plurality of magnetic poles, and manually operable clamping means for clamping said beam adjusting assemblies in stacked relation on said mounting sleeve to maintain the adjustment of said assemblies, said clamping means including a camming ring rotatably mounted on said sleeve and stacked with said beam adjusting assemblies, and an additional ring stacked on said sleeve with said camming ring, said camming ring and said additional ring having camming means operable therebetween in response to rotation of said camming ring for producing clamping pressure upon said beam adjusting assemblies, said camming means including cam elements on said camming ring, and springs on said additional ring for engaging and following said cam elements.

15. A convergence device for television picture tubes, comprising a mounting sleeve having an axial opening for receiving the neck of a television picture tube, three beam adjusting assemblies stacked on said mounting sleeve, each of said beam adjusting assemblies including a pair of magnet rings rotatably mounted around said mounting sleeve and stacked thereon, and means for producing rotation of said magnet rings in opposite directions about the axis of said mounting sleeve, each of said magnet rings being formed with a plurality of magnetic poles, and manually operable clamping means for clamping said beam adusting assemblies in stacked relation on said mounting sleeve to maintain the adjustment of said assemblies, said clamping means including a camming ring rotatably mounted on said sleeve and stacked with said beam adjusting assemblies, and an additional ring stacked on said sleeve with said camming ring, said camming ring and said additional ring having camming means operable therebetween in response to rotation of said camming ring for producing clamping pressure upon said beam adjusting assemblies, said camming means including cam elements on said camming rings, spring elements on said additional ring for engaging and following said cam elements, and backup elements on said additional ring for backing up said spring elements to limit deflection thereof and to produce solid clamping of said beam adjusting assemblies.

16. A convergence device for television picture tubes, comprising a mounting sleeve having an axial opening for receiving the neck of a television picture tube, three beam adjusting assemblies stacked on said mounting sleeve, each of said beam adjusting assemblies including a pair of magnet rings rotatably mounted around said mounting sleeve and stacked thereon, and means for producing rotation of said magnet rings in opposite directions about the axis of said mounting sleeve, each of said magnet rings being formed with a plurality of magnetic poles, and manually operable clamping means for clamping said beam adjusting assemblies in stacked relation on said mounting sleeve to maintain the adjustment of said assemblies, said clamping means including a camming ring rotatably mounted on said sleeve and stacked with said beam adjusting assemblies, and an additional ring stacked on said sleeve with said camming ring, said camming ring and said additional ring having camming means operable therebetween in response to rotation of said camming ring for producing clamping pressure upon said beam adjusting assemblies, said camming means including cam recesses in said camming ring, and spring elements on said additional ring for reception in said cam recesses and deflection by said camming ring in response to rotation of said camming ring.

17. A convergence device for television picture tubes, comprising a mounting sleeve having an axial opening for receiving the neck of a television picture tube, three beam adjusting assemblies stacked on said mounting sleeve, each of said beam adjusting assemblies including a pair of magnet rings rotatably mounted around said mounting sleeve and stacked thereon, and means for producing rotation of said magnet rings in opposite directions about the axis of said mounting sleeve, each of said magnet rings being formed with a plurality of magnetic poles, and manually operable clamping means for clamping said beam adjusting assemblies in stacked relation on said mounting sleeve to maintain the adjustment of said assemblies, said clamping means including a camming ring rotatably mounted on said sleeve and stacked with said beam adjusting assemblies, and an additional ring stacked on said sleeve with said camming ring, said camming ring and said additional ring having camming means operable therebetween in response to rotation of said camming ring for producing clamping pressure upon said beam adjusting assemblies, said camming means including cam elements on said camming ring, spring elements on said additional ring for engagement and deflection by said cam elements in response to rotation of said camming ring, and projections on said additional ring for limiting the deflection of said spring elements to produce solid clamping of said beam adjusting assemblies.

18. A device according to claim 17, in which said spring elements take the form of compression bow springs on said additional ring, said projections being disposed on said additional ring behind said bow springs for solid engagement by said bow springs to limit deflection thereof.

19. A convergence device for television picture tubes, comprising a mounting sleeve having an axial opening for receiving the neck of a television picture tube, three beam adjusting assemblies supported on said mounting sleeve, each of said beam adjusting assemblies including a supporting ring member projecting outwardly from said mounting sleeve, a pair of magnet rings rotatably mounted around said mounting sleeve and stacked upon said supporting ring member, said magnet rings having respective bevel gears formed in one piece with said magnet rings and facing toward each other, a rotatable generally radial adjusting shaft having a bevel pinion meshing with and disposed between said bevel gears on said magnet rings, and shaft supporting means on said supporting ring member and supporting said shaft for rotation about a generally radial axis relative to the axis of the mounting sleeve, said shaft being rotatable to cause rotation of said magnet rings in opposite directions about the axis of said mounting sleeve, each of said magnet rings being formed with a plurality of magnetic poles, at least two of said beam adjusting assemblies being rotatable about said supporting sleeve, and retaining means for retaining said beam adjusting assemblies in stacked relation on said mounting sleeve, said retaining means including spring means pressing said beam adjusting assemblies into stacked relation.

20. A convergence device for television picture tubes, comprising a mounting sleeve having an axial opening for receiving the neck of a television picture tube, three beam adjusting assemblies supported on said mounting sleeve, each of said beam adjusting assemblies including a supporting ring member projecting outwardly from said mounting sleeve, a pair of magnet rings rotatably mounted around said mounting sleeve and stacked upon said supporting ring member, said magnet rings having respective bevel gears formed in one piece with said magnet rings and facing toward each other, a rotatable generally radial adjusting shaft having a bevel pinion meshing with and disposed between said bevel gears on said magnet rings, and shaft supporting means on said supporting ring member and supporting said shaft for rotation about a generally radial axis relative to the axis of the mounting sleeve, said shaft being rotatable to cause rotation of said magnet rings in opposite directions about the axis of said mounting sleeve, each of said magnet rings being formed with a plurality of magnetic poles, at least two of said beam adjusting assemblies being rotatable about said supporting sleeve, and retaining means for retaining said beam adjusting assemblies in stacked relation on said mounting sleeve, said retaining means including a retaining ring mounted on said sleeve, and a plurality of springs carried by said retaining ring and pressing said beam adjusting assemblies into stacked relation.

21. A device according to claim 20, in which said springs take the form of bow springs mounted on said retaining ring and pressing said beam adjusting assemblies into stacked relation.

22. A device according to claim 21, in which said retaining ring is formed with recesses for receiving said bow springs.

* * * * *